US010400454B1

(12) United States Patent
Iellimo et al.

(10) Patent No.: US 10,400,454 B1
(45) Date of Patent: Sep. 3, 2019

(54) STRUCTURAL MEMBER WITH AN ANTI-ROTATIONAL FEATURE

(71) Applicant: FRAZIER INDUSTRIAL COMPANY, Long Valley, NJ (US)

(72) Inventors: Domenick Iellimo, Forked River, NJ (US); Aaron Iellimo, Califon, NJ (US)

(73) Assignee: Frazier Industrial Company, Long Valley, NJ (US)

( * ) Notice: Subject to any disclaimer, the term of this patent is extended or adjusted under 35 U.S.C. 154(b) by 0 days.

(21) Appl. No.: 15/945,243

(22) Filed: Apr. 4, 2018

(51) Int. Cl.
*E04C 3/07* (2006.01)
*E04B 1/19* (2006.01)
*E04C 3/04* (2006.01)

(52) U.S. Cl.
CPC ..... *E04C 3/07* (2013.01); *E04B 1/19* (2013.01); *E04B 2001/1963* (2013.01); *E04C 2003/046* (2013.01)

(58) Field of Classification Search
CPC ..... E04C 3/07; E04C 2003/046; E04B 1/19; E04B 2001/1963; E04B 1/2403; E04B 2001/2415; E04B 2001/2418; E04B 2001/2457
See application file for complete search history.

(56) References Cited

U.S. PATENT DOCUMENTS 2,384,849 A 9/1945 Pieri
5,012,938 A 5/1991 King
5,312,004 A 5/1994 Krummell, Jr.
5,411,153 A 5/1995 Unfried
5,542,549 A * 8/1996 Siemon ..... H04Q 1/14 211/189
6,327,828 B1 12/2001 Carroll
6,450,350 B1 9/2002 Krummell, Jr.
8,727,144 B2 * 5/2014 Krummell ..... B65G 1/02 211/191
8,833,039 B2 9/2014 Gallagher, Jr.
9,066,585 B2 6/2015 Kirby
2006/0185312 A1 * 8/2006 Weeks ..... E04B 1/24 52/653.1
2009/0277854 A1 11/2009 Eustace
2010/0254753 A1 10/2010 Mulholland

* cited by examiner

*Primary Examiner* — Patrick J Maestri
(74) *Attorney, Agent, or Firm* — Dilworth & Barrese, LLP

(57) ABSTRACT

A structural member with a central portion that has a first piece and a second piece which form a cross-sectional L-shape configuration along a longitudinal axis is disclosed herein. When fastened to a horizontal bar, the first piece of the structural member may come into contact with a portion of the horizontal bar, thereby preventing the structural member from rotating. The structural member includes a connection component that extends from an end of the first piece, and the connection component extends substantially perpendicular to the first piece. The connection component may be configured in at least two different embodiments in that the connection component may include two holes or three holes. The implementation of more than one hole on the connection component allows the structural member to be universal in that it can be implemented on varying sized storage racks that employ different sized horizontal bars.

20 Claims, 17 Drawing Sheets

STRUCTURAL MEMBER WITH AN ANTI-ROTATIONAL FEATURE

BACKGROUND

Storage systems are used in warehouses, department stores, and storage facilities to store products thereon. The storage systems containing a plurality of storage racks may hold and support large amounts and often heavy materials. Storage racks often employ a number of vertical columns that are sturdily positioned on a base or floor, and then a plurality of horizontal bars and platforms may connect to and be fastened to the vertical columns. The horizontal bars and platforms may include a number of structural members, and all of these components operate together in order to adequately support heavy amounts of material. Some components, such as structural members, that help support the heavy materials may at times loosen or support so much weight that the structural members begin to rotate, thereby hindering the ability of the storage rack to evenly and reliably support objects and other materials.

In addition, companies employing storage systems each have different sized storage racks for the respective company's particular purpose. For example, some storage racks may include platforms or horizontal support bars that have a width of three inches, four inches, or three and a half inches. Each increasing width is able to hold more weight, but may also be more costly to manufacture for the company. Thus, if the storage racks that employ three-inch width horizontal support bars are sufficient for a company's purpose, then the company will not need to spend additional money on the storage racks that employ three and a half inch or four inch width horizontal support bars. Some structural members may not be effected by the size of the storage rack, and therefore the same sized structural member may work and be employed for each varying sized storage rack. However, each structural member may need to have a hole drilled in different locations thereon, in order to fasten the structural member to the different sized horizontal support bars.

SUMMARY

A universal structural member that includes multiple holes drilled thereon and is adaptable to multiple sized storage racks is disclosed herein. Furthermore, the universal structural member is configured in such a manner so as to prevent the structural member from rotating when fastened to any of the various sized horizontal bars, that is, three inch, four inch, and three and a half inch structural bars. Specifically, if the structural member begins to rotate then a portion of the structural member may come into contact with an upper plane of the horizontal bar, thereby prohibiting the structural member from rotating in either direction.

A structural member has a central portion defining a longitudinal axis and includes a first end and a second end. The central portion has a substantially uniform cross-sectional L-shape configuration along the longitudinal axis. A first connection component extending from the first end of the structural member and has at least two holes defined therethrough. The two holes are off-centered on the connection component.

DETAILED DESCRIPTION

The present disclosure may be understood more readily by reference to the following detailed description of the disclosure taken in connection with the accompanying figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Reference will now be made in detail to the exemplary embodiments of the present disclosure, which are illustrated in the accompanying drawings.

Figure 1:
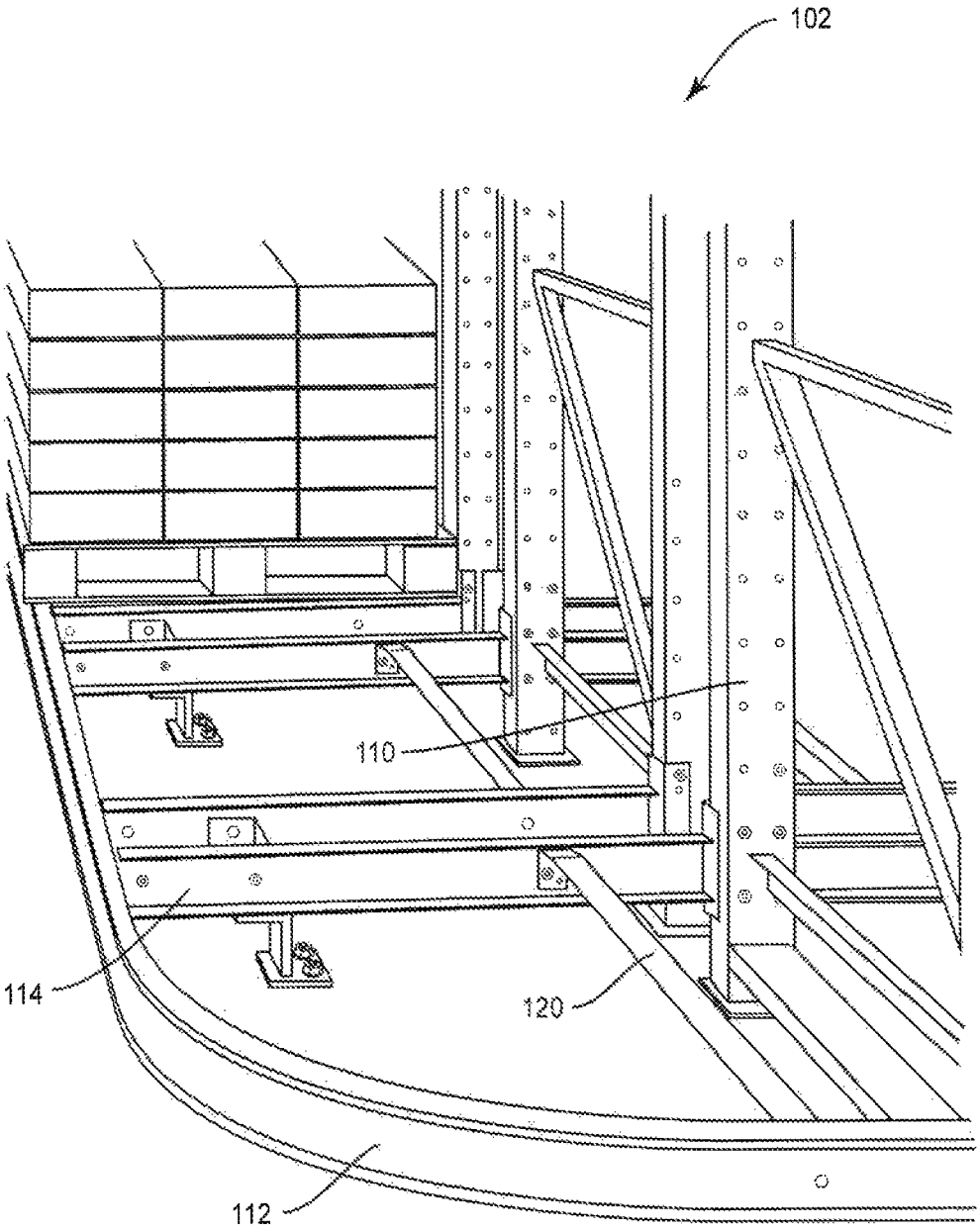
FIG. 1 is an overview of a storage rack in accordance with aspects of the present disclosure.

FIG. 1 illustrates an example of storage rack 102 when fully assembled. For instance, vertical column 110 extends longitudinally up from a ground or base. Horizontal bar 114 and platform 112 is connected to vertical column 110. A structural member 120 is positioned and extends between platform 112 and horizontal bar 114 as well. Although FIG. 1 shows horizontal bar 114, platform 112, and structural member 120 at a lower portion of vertical column 110, it should be understood that horizontal bar 114, platform 112, and structural member 120 may be positioned at any location along vertical column 110. Furthermore, although FIG. 1 depicts the present disclosure being implemented on a first level, it should be understood that the present technology may be implemented on a second level or any number of levels as well.

FIGS. 2A-E provide exemplary views of structural member 120. Structural member 120 includes a central portion 122 which is comprised of a first piece 124 and a second piece 126 that form central portion 122 into an L-shape. First piece 124 includes a first end 128 and a second end 131, which is opposite first end 128.

Figure 2A:
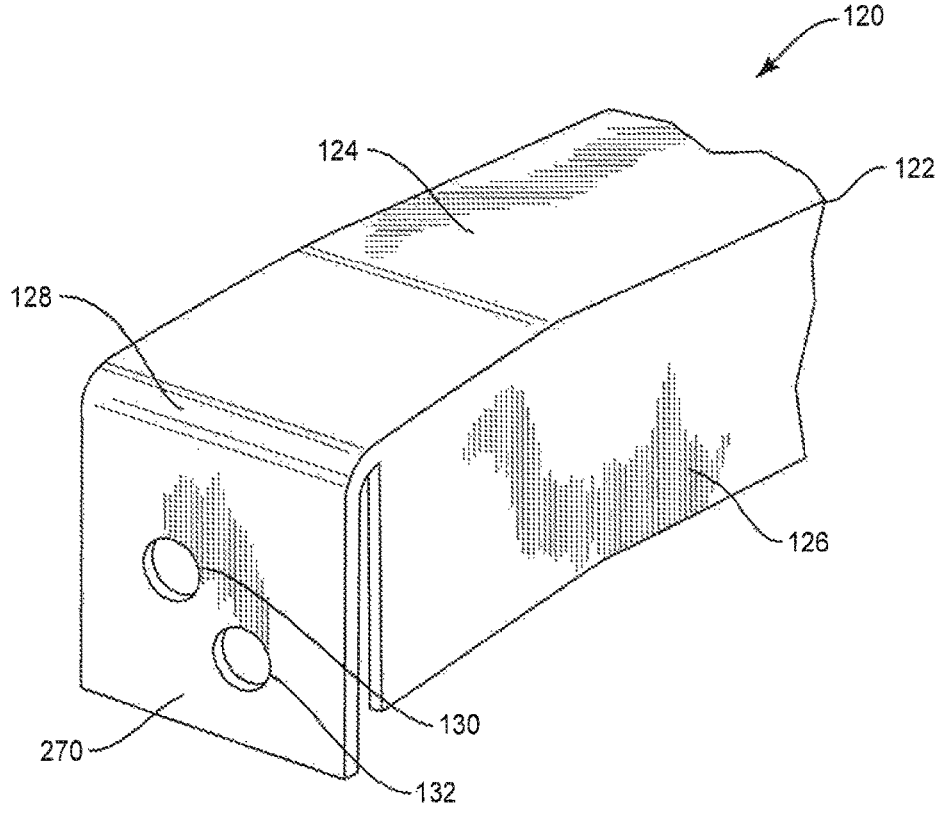
FIGS. 2A-E illustrate a first embodiment of a structural member of the storage rack in accordance with aspects of the present disclosure.
Figure 2B:
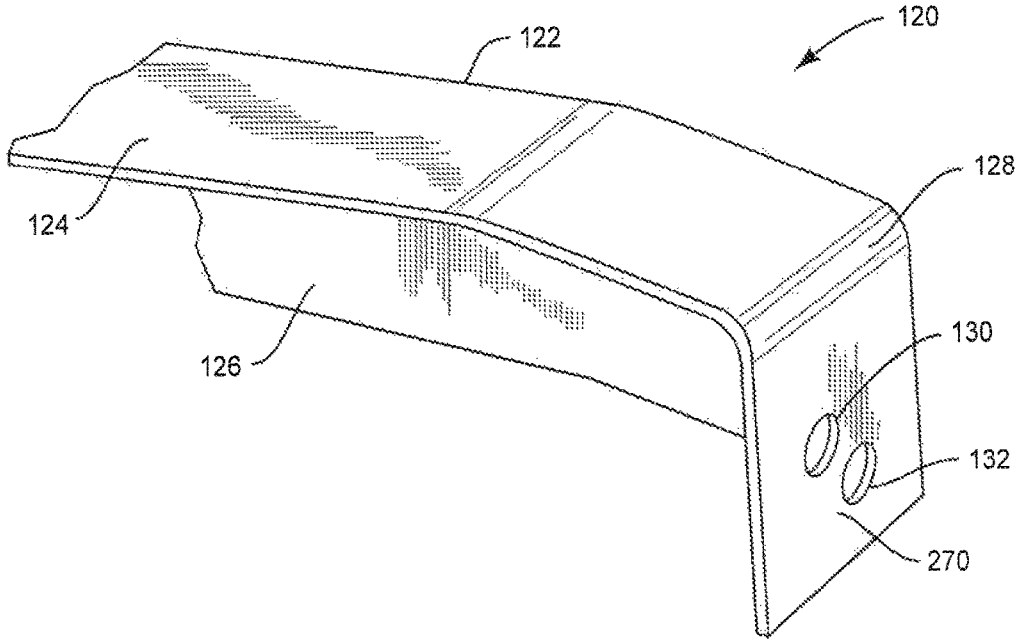
Figure 2C:
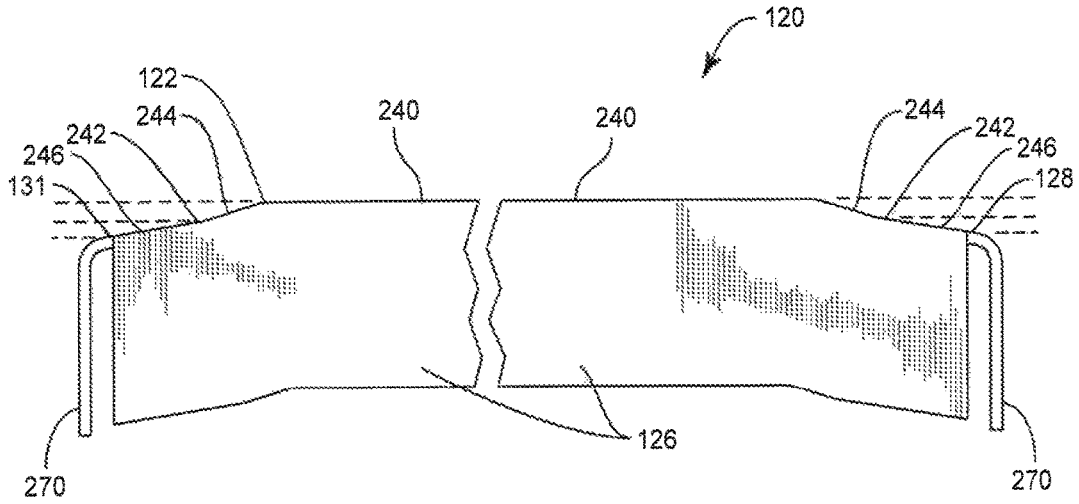
Figure 2D:
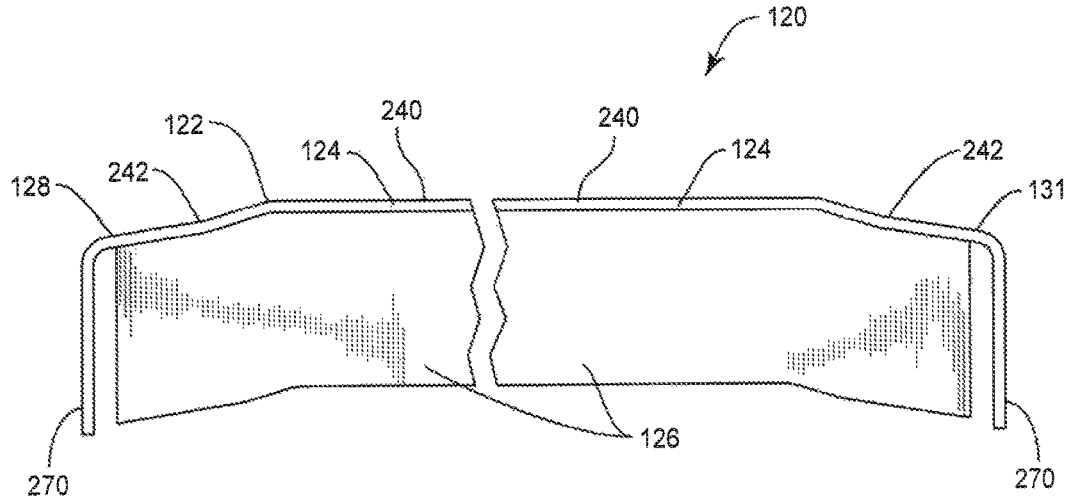
Figure 2E:
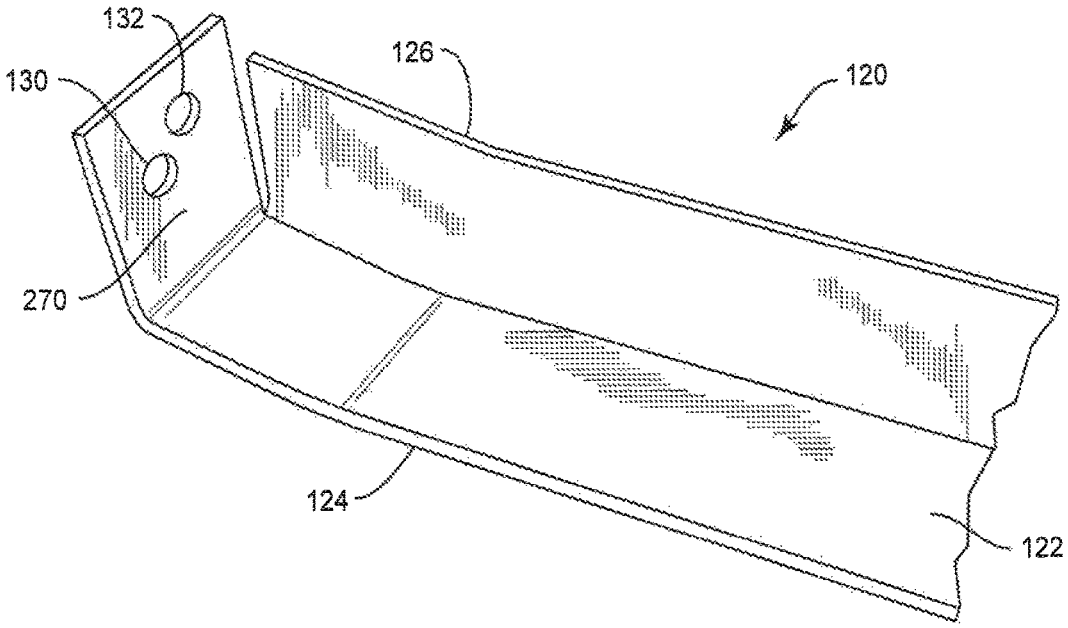

As shown in FIGS. 2C-D, a first portion 240 of first piece 124 forms a first plane. Adjacent to first end 128 and also second end 130 is a second portion 242, which includes a slope that forms one or more planes at a different angle from the first plane. For example, instead of first piece 124 extending only about a first plane, second portion 242 slopes at a downward angle. First piece 124 includes the slope so that structural member 120 is able to connect to horizontal bar 114 or platform 112. For example, referring to FIGS. 3A-B, structural member 120 is placed within opening 360 of horizontal bar 114 in order to fasten thereto. In this regard, if second portion 242 of first piece 124 did not include the slope thereon, then first piece 124 may interfere with connecting structural member 120 with horizontal bar 114 by colliding with upper plane 334.

Furthermore, second portion 242 of structural member 120 includes two slopes that form a plane at a different angle than the first plane of first portion 240. Specifically, as shown in FIG. 2C first slope 244 forms a plane at a first angle and then second slope 246 forms a plane at a different angle. First slope 244 and second slope 246 are present in order to allow first piece 124 of structural member 120 to snugly fit and fasten to horizontal bar 114, as discussed in further detail below. First slope 244 is steeper than second slope 246. In a preferred embodiment, the angle of first slope 244 is about 17° with the first portion 240 and the angle of the second slope 246 is about 9° with the first portion 240.

As shown in FIGS. 2A-E, structural member 120 includes two holes on connection component 270 thereof. A connection component 270 is positioned on both ends of structural member 120, that is, first end 128 and second end 130. Connection component 270 extends substantially perpendicular to first piece 124. First hole 130 and second hole 132 are positioned off-centered with respect to connection component 270. Furthermore, the two holes on connection component 270 are employed so that structural member 120 is able to connect to different sized horizontal members.

Figure 3A:
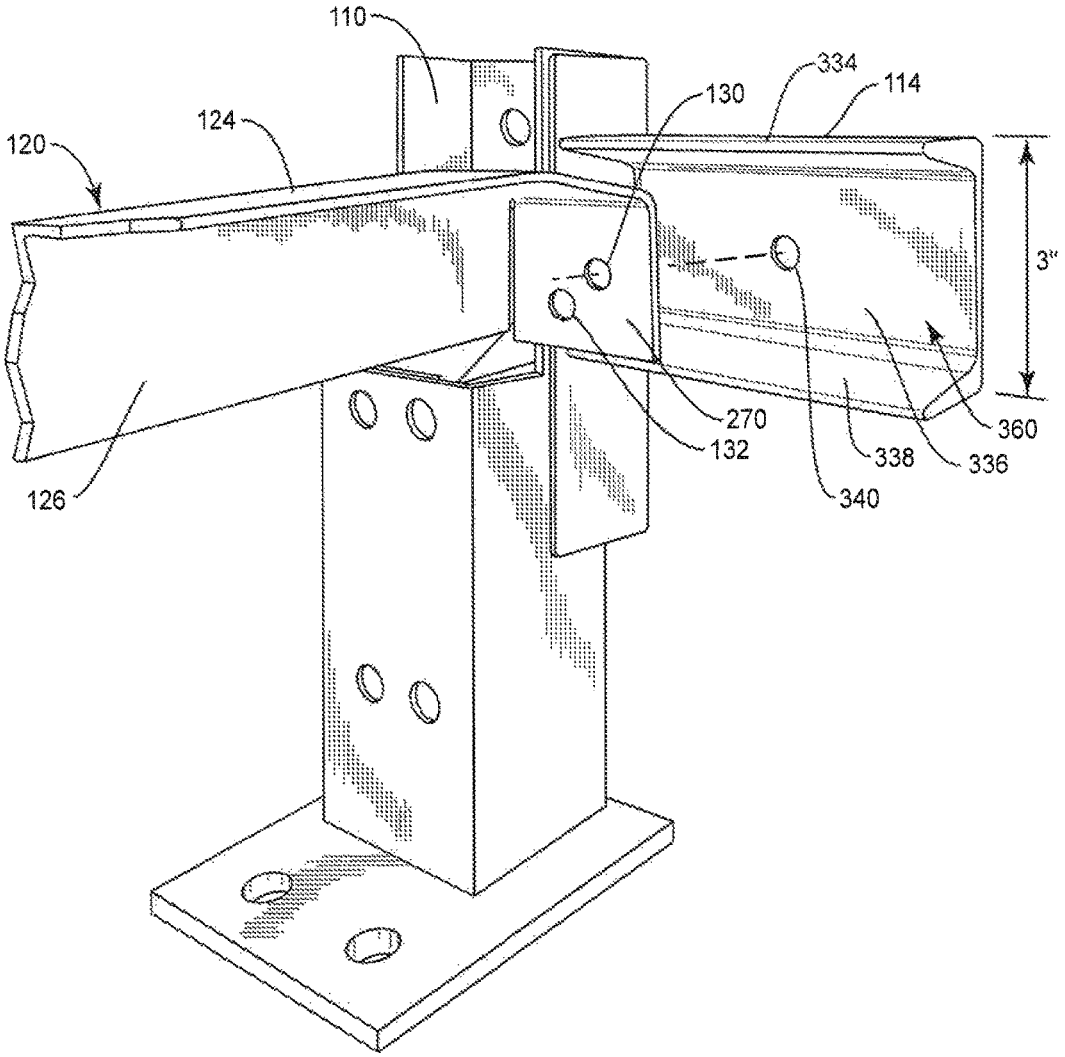
FIGS. 3A-B illustrate the structural member connecting with a horizontal bar in accordance with aspects of the disclosure.
Figure 3B:
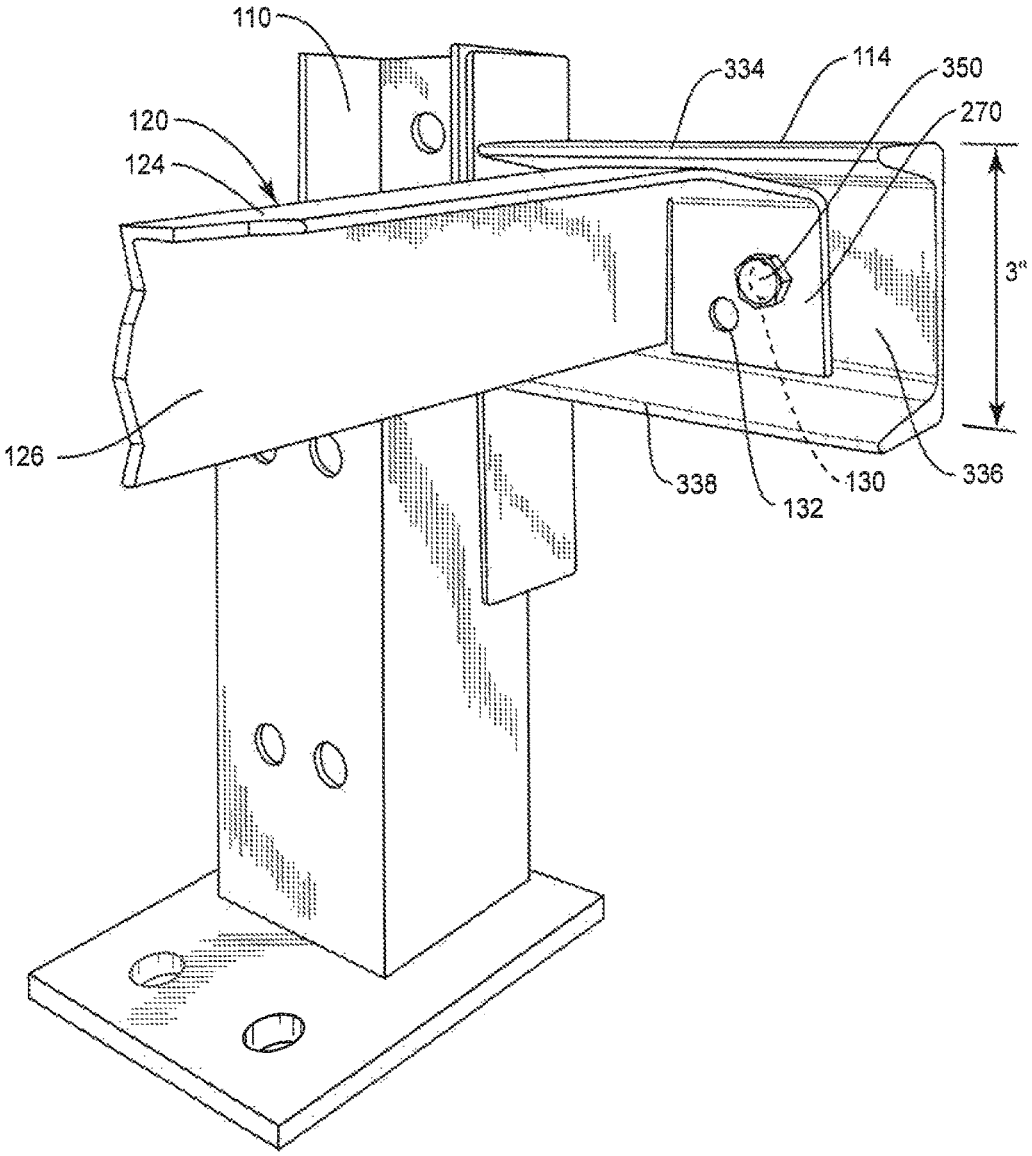

For instance, FIGS. 3A-B provide an example of structural member 120 connected to horizontal member 114, which has a width of three inches, that is, the length perpendicular to the longitudinal axis of the horizontal bar is three inches. Horizontal bar 114 is defined by an upper plane 334, middle plane 336, and lower plane 338. Upper plane 334 and lower plane 338 extend substantially parallel to the plane of first portion 240 of first piece 124 of structural member 120. Middle plane 336 is positioned at least partially between upper plane 334 and lower plane 338, and extends in a direction perpendicular to upper plane 334 and lower plane 336.

Connection component 270 of structural member 120 is positioned adjacent to middle plane 336 of horizontal bar 114. In addition, first piece 124 of structural member 120 is positioned adjacent to upper plane 334. In this scenario, since the width of structural member 114 is three inches, in order to fasten structural member 120 to horizontal bar 114, a bolt 350 is fastened to first hole 130 of structural member 120. As seen in FIG. 3A, the first hole 130 aligns with center hole 340 when connecting structural member 120 to the three inch horizontal bar 114. Center hole 340 is positioned in the center of middle plane 336 of horizontal bar 114. In this regard, first hole 130 is positioned such that structural member 114 snugly fits against middle plane 336 of horizontal bar 114 and first piece 124 is positioned adjacent to upper plane 334.

Figure 3C:
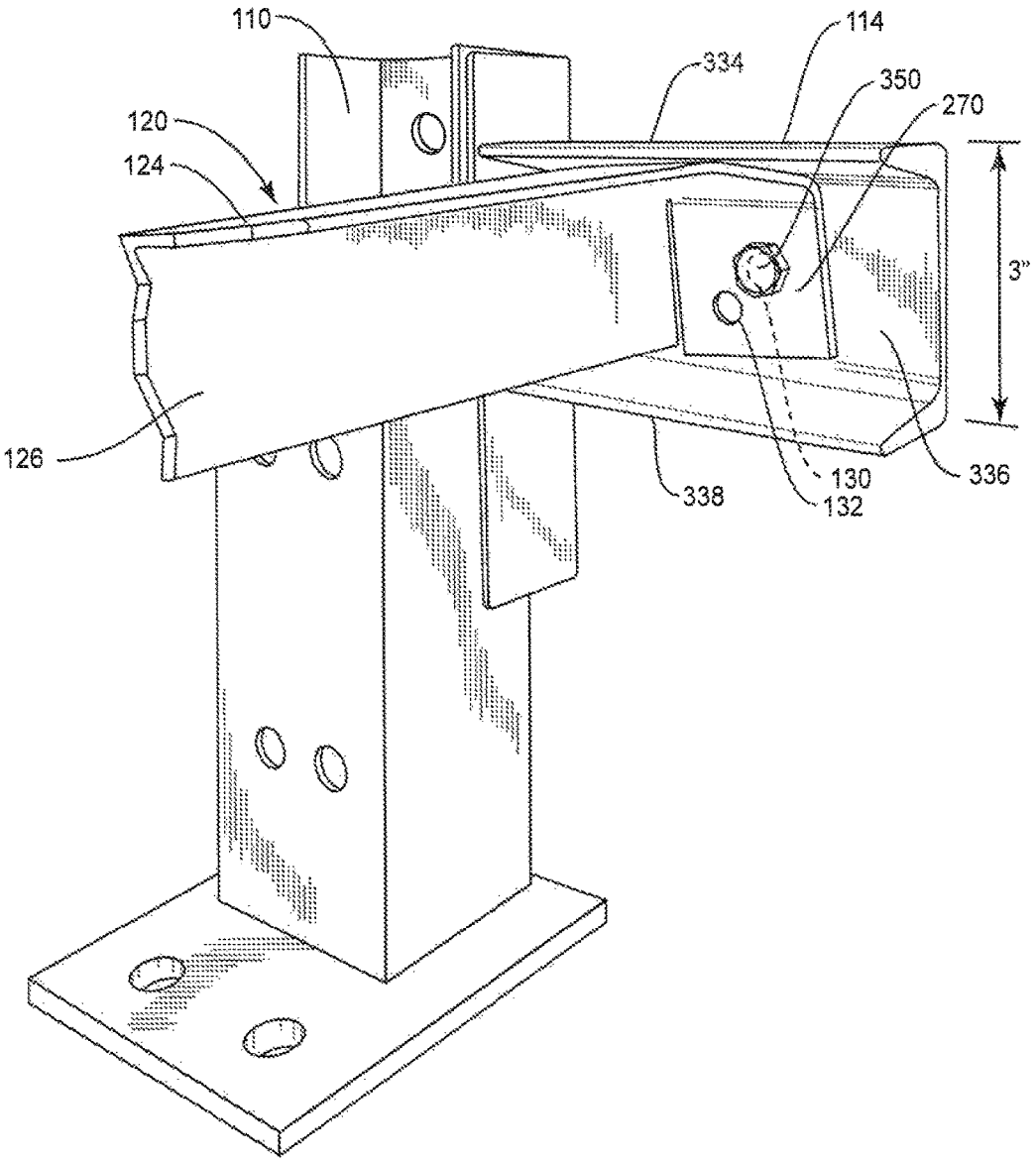
FIGS. 3C-D depict the structural member rotating in opposite directions and the horizontal bar prohibiting a full rotation in accordance with aspects of the present disclosure.
Figure 3D:
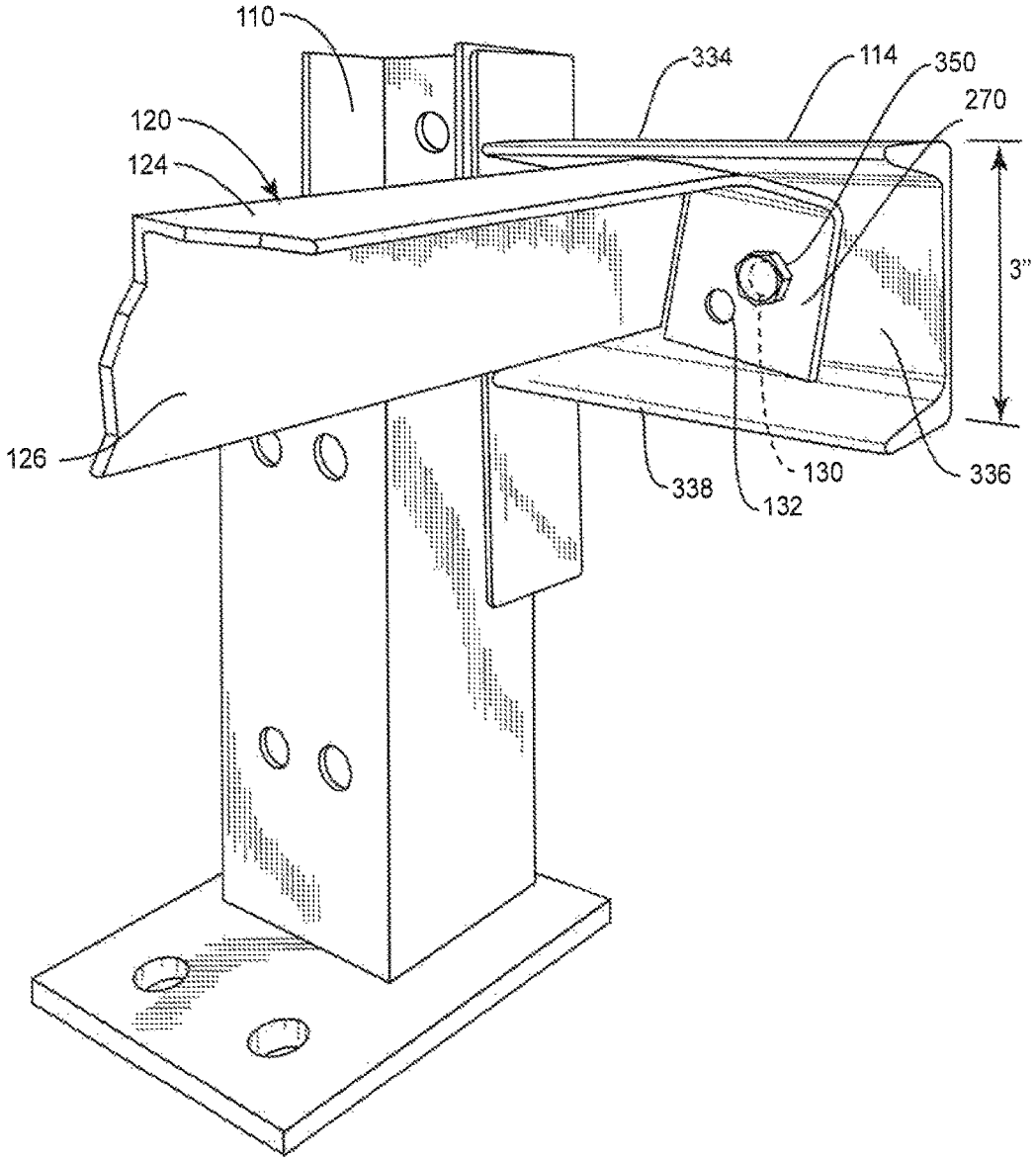

First piece 124 is positioned adjacent to upper plane 334 so that should weight or some other pressure be exerted against structural member 120, a top portion of first piece 124 will come into contact with a bottom portion of upper plane 334. Therefore, if the fastening mechanism that connects structural member 120 to horizontal bar 114 is not able to completely halt structural member 120 from spinning or rotating about a rotational axis, then upper plane 334 will prohibit such rotation. Specifically, top piece 124 may rotate mildly until a portion of first piece 124 comes into direct contact with upper plane 334. Furthermore, given the positioning of first hole 130 and center hole 340, structural member 120 is fastened to horizontal bar 114 in such a position that structural member 120 may come into contact with horizontal bar 114 in either rotational directions of structural member 120. For example, FIGS. 3C-D illustrate a portion of first piece 124 colliding with upper plane 334 in left or right rotational direction of structural member 120. Thus, in addition to structural member 120 being a universal connecting component, it also serves as an anti-rotation device as well so that structural member 120 is always level.

Figure 4A:
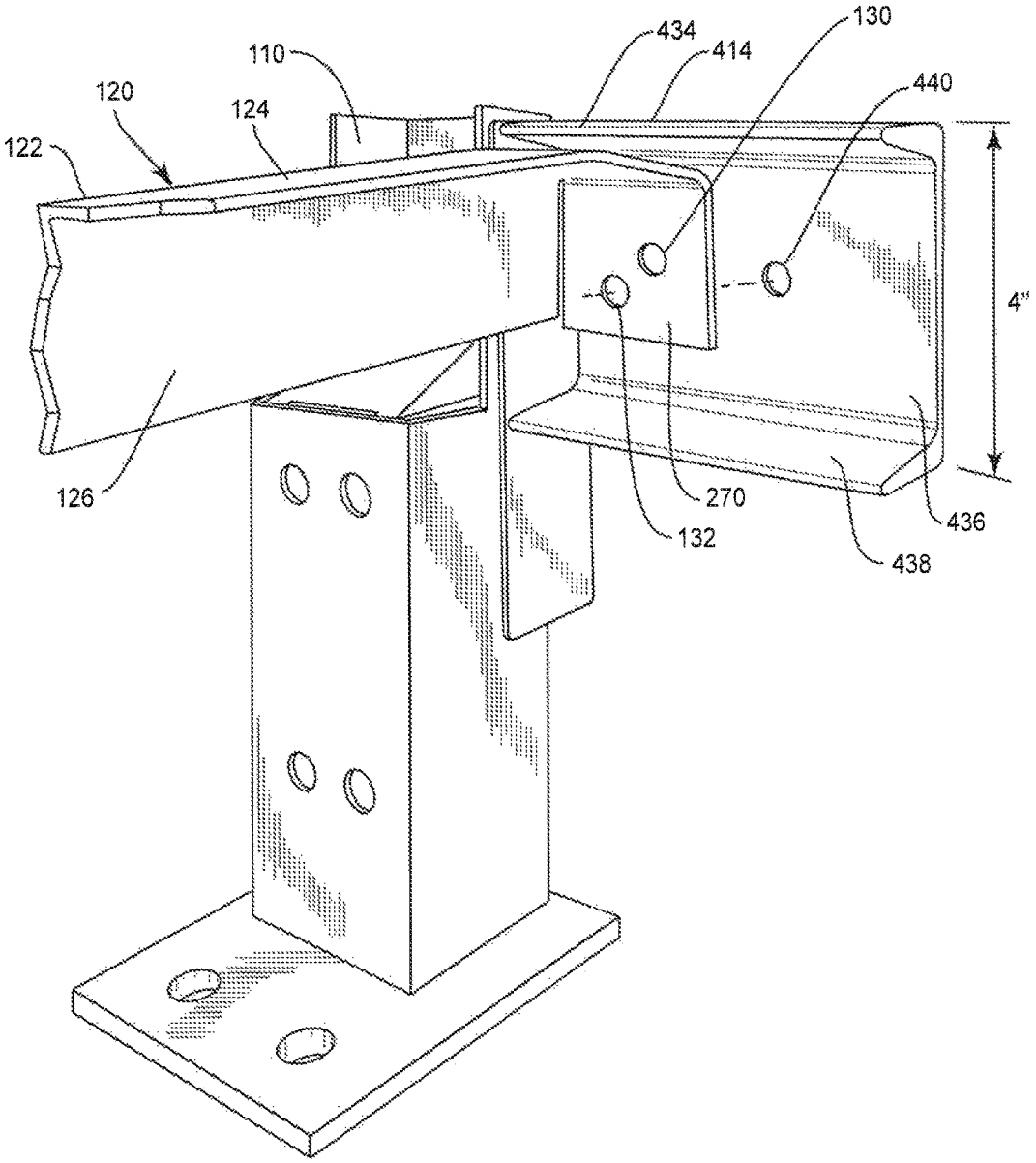
FIGS. 4A-B illustrate the structural member connecting with a different horizontal bar in accordance with aspects of the present disclosure.
Figure 4B:
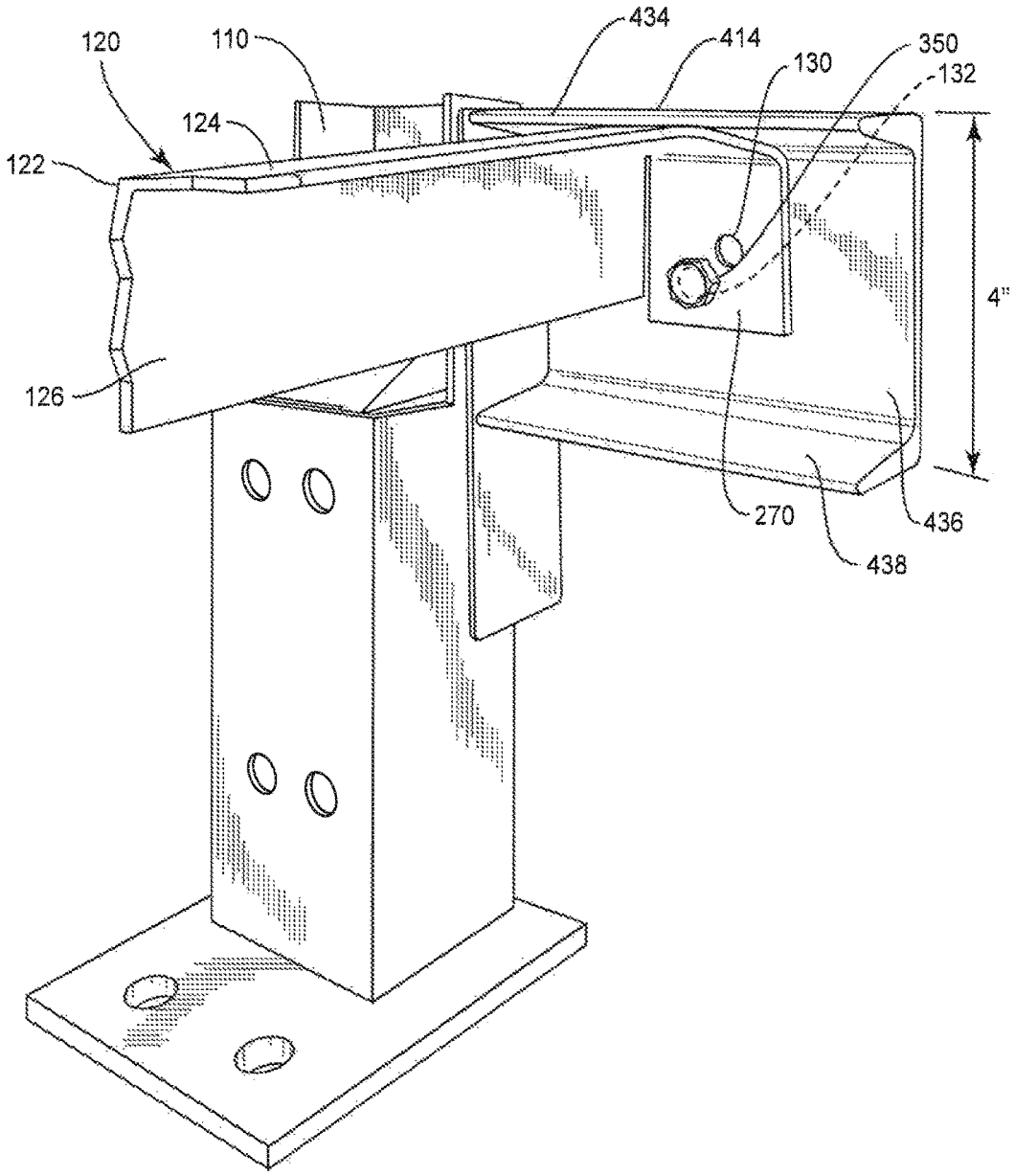

Furthermore, as illustrated in FIGS. 4A-B, structural member 120 is also able to securely mate with four inch horizontal bar 414. Specifically, the width of horizontal bar 414 is four inches, that is, the length perpendicular to a longitudinal axis of horizontal bar 414 is four inches. In this regard, structural member 120 has been configured such that it can be implemented with multiple sized horizontal bars, such as three-inch horizontal bar 114 and four-inch horizontal bar 414, as illustrated in FIGS. 3A-D and FIGS. 4A-B, respectively. For instance, as shown in FIGS. 4A-B second hole 132 of structural member 120 aligns with center hole 440 on four inch horizontal bar 414. Furthermore, four inch horizontal member 414 may be configured similarly to three inch horizontal member 114 in that horizontal member 414 includes an upper plane 434, middle plane 436, and lower plane 438. Therefore, when structural member 120 is connected to or otherwise fastened with horizontal bar 414, first piece 124 is positioned adjacent to upper plane 434 and connection component 270 is positioned adjacent to middle plane 436.

Figure 5A:
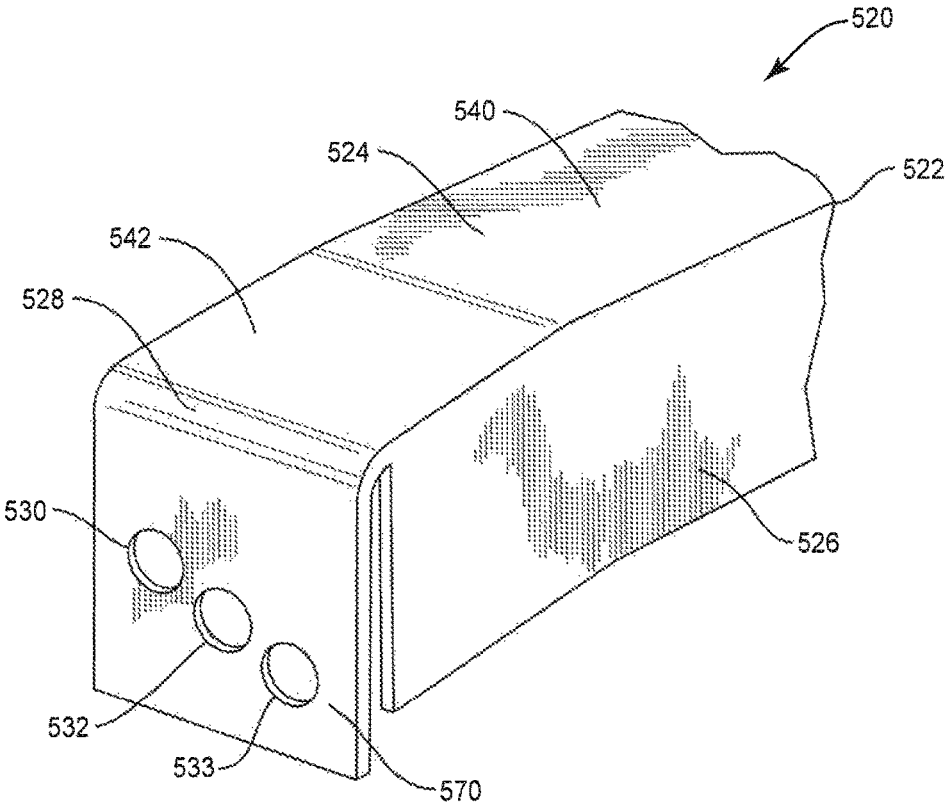
FIGS. 5A-B illustrate a second embodiment of a structural member of the storage rack in accordance with aspects of the present disclosure.
Figure 5B:
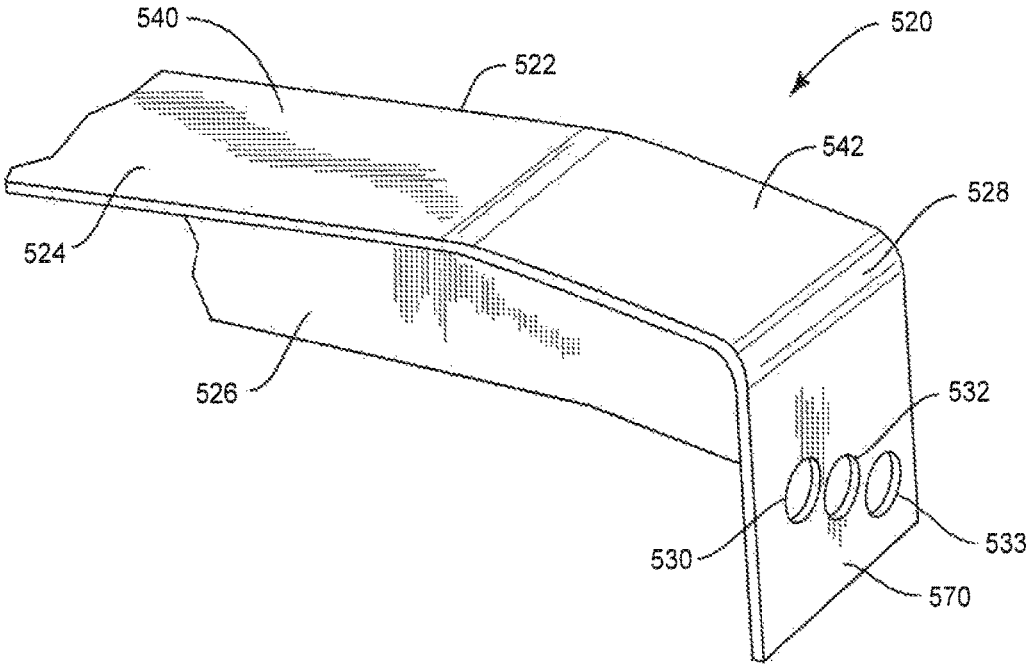

As an alternative embodiment, as illustrated in FIG. 5 structural member 520 includes three holes on connection component 570. Connection component 570 includes a first hole 530, second hold 532, and third hole 533, which are each off-centered on connection component 570. Similar to the two holes on structural member 120, the three holes of connection component 570 are off-centered and positioned in such a manner such that structural member 520 can be utilized with multiple sized widths of horizontal bars, namely a three-inch horizontal bar, four-inch horizontal bar, and a three and a half inch horizontal bar.

Furthermore, similar to structural member 120 discussed above, structural member 520 includes a central portion 522 that defines a first piece 524 and a second piece 526, which form an L-shape of central portion 522. First piece 524 includes a first end 528 and a second end (not shown) that is opposite first end 528 and configured similarly.

Additionally, a first portion 540 of first piece 524 forms a first plane. Adjacent to first end 528 is a second portion 542, which includes a slope that forms one or more planes at a different angle from the first plane. For example, instead of first piece 524 extending only about a first plane, second portion 542 slopes at one or more locations at a downward angle, similar to second portion 242 as discussed above with respect to structural member 120. First piece 524 includes the slope so that structural member 520 is able to connect to horizontal bar 514. For example, referring to FIGS. 6A-B, structural member 520 is placed within opening 360 of horizontal bar 114 in order to fasten thereto. In this regard, if second portion 542 of first piece 524 did not include the slope thereon, then first piece 124 may interfere with connecting structural member 520 with horizontal bar 114 by colliding with upper plane 334.

Figure 6A:
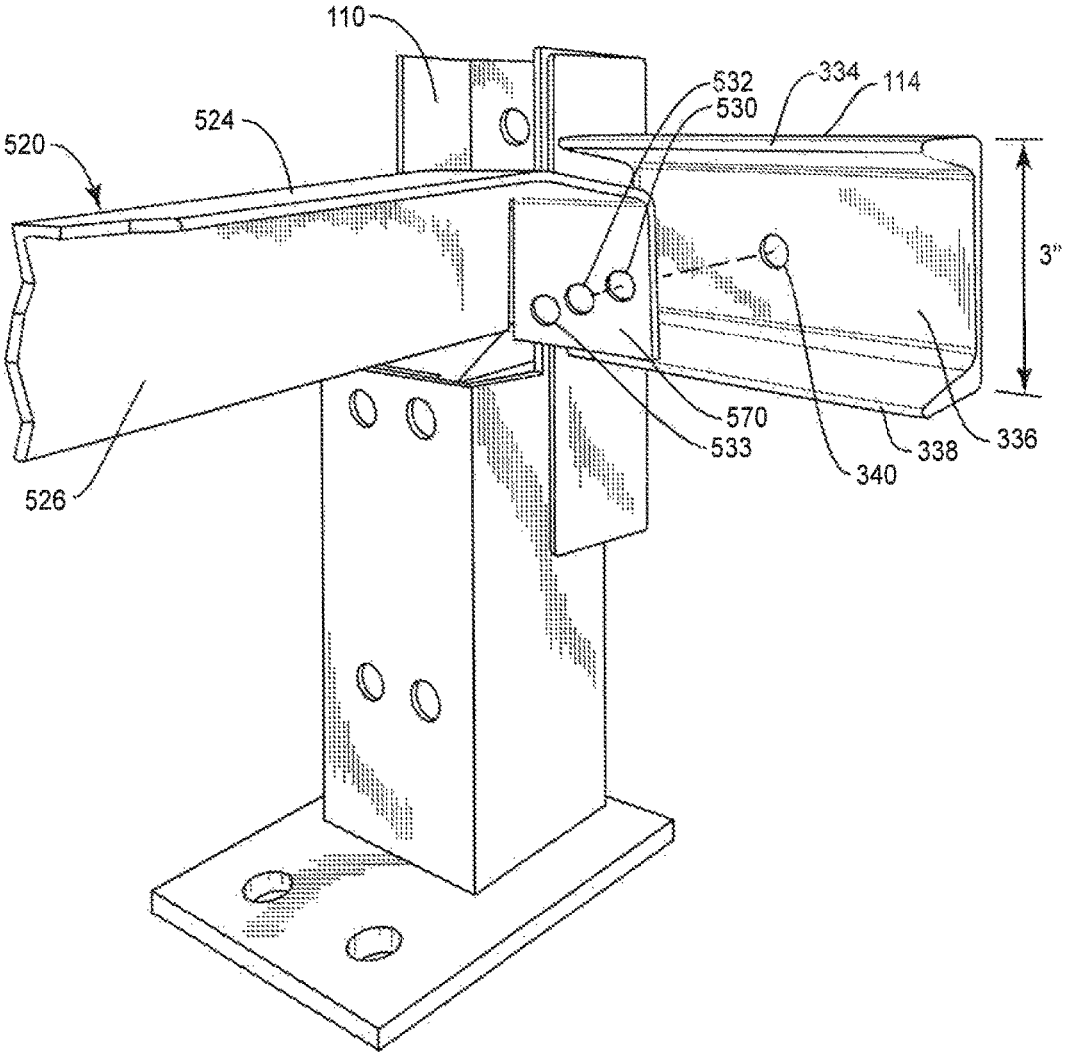
FIGS. 6A-B illustrate the three-hole structural member connecting with the horizontal bar having the first size in accordance with aspects of the present disclosure.
Figure 6B:
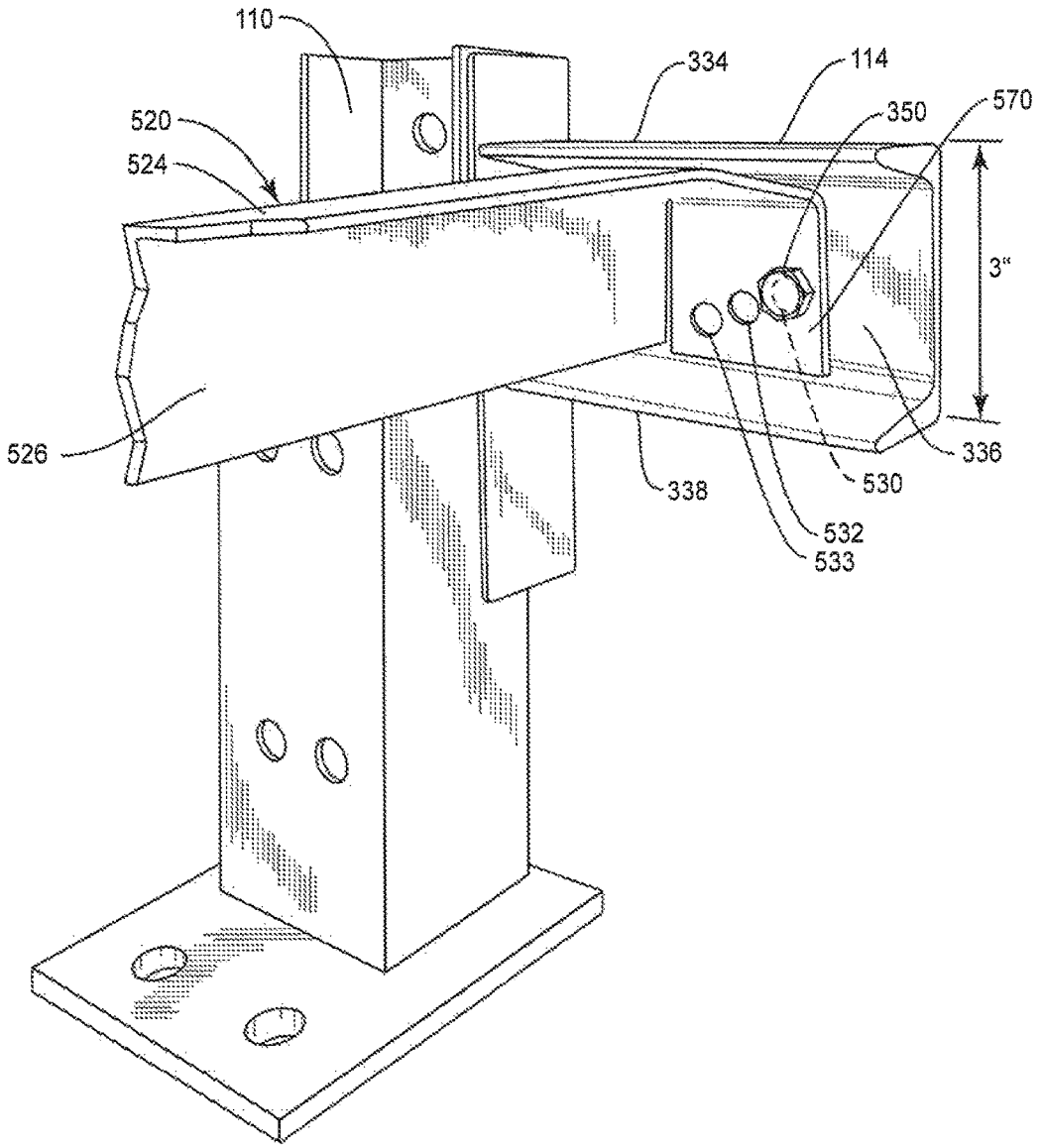

Referring to FIGS. 6A-B, first hole 530 of structural member 520 is aligned with center hole 340 of three-inch horizontal bar 114. When connected, first piece 524 of structural member 520 is adjacent to upper plane 334 and connection component 570 is fastened to and adjacent to middle plane 336.

Figure 7A:
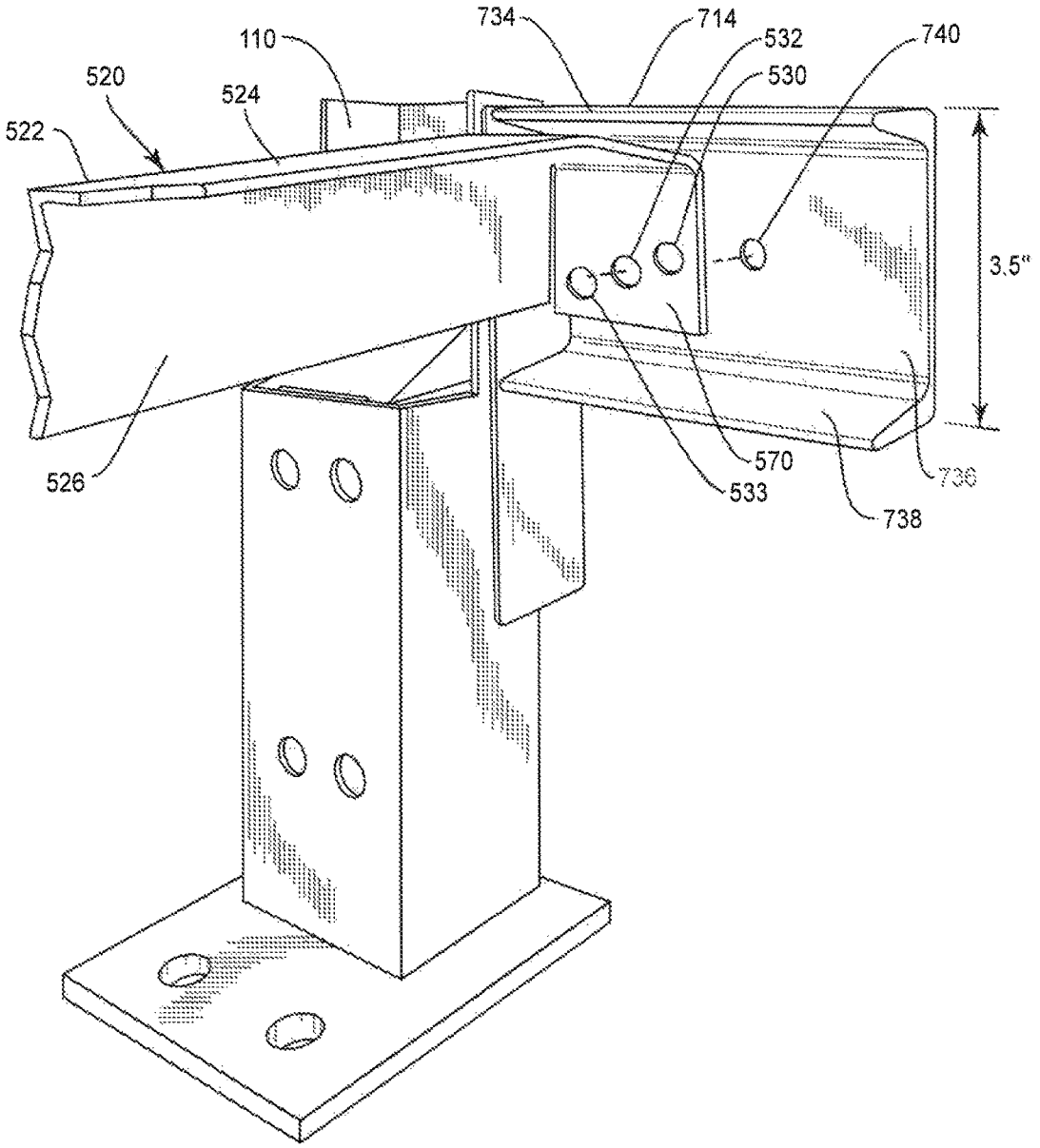
FIGS. 7A-B illustrate the three-hole structural member connecting with the horizontal bar having the second size in accordance with aspects of the present disclosure.
Figure 7B:
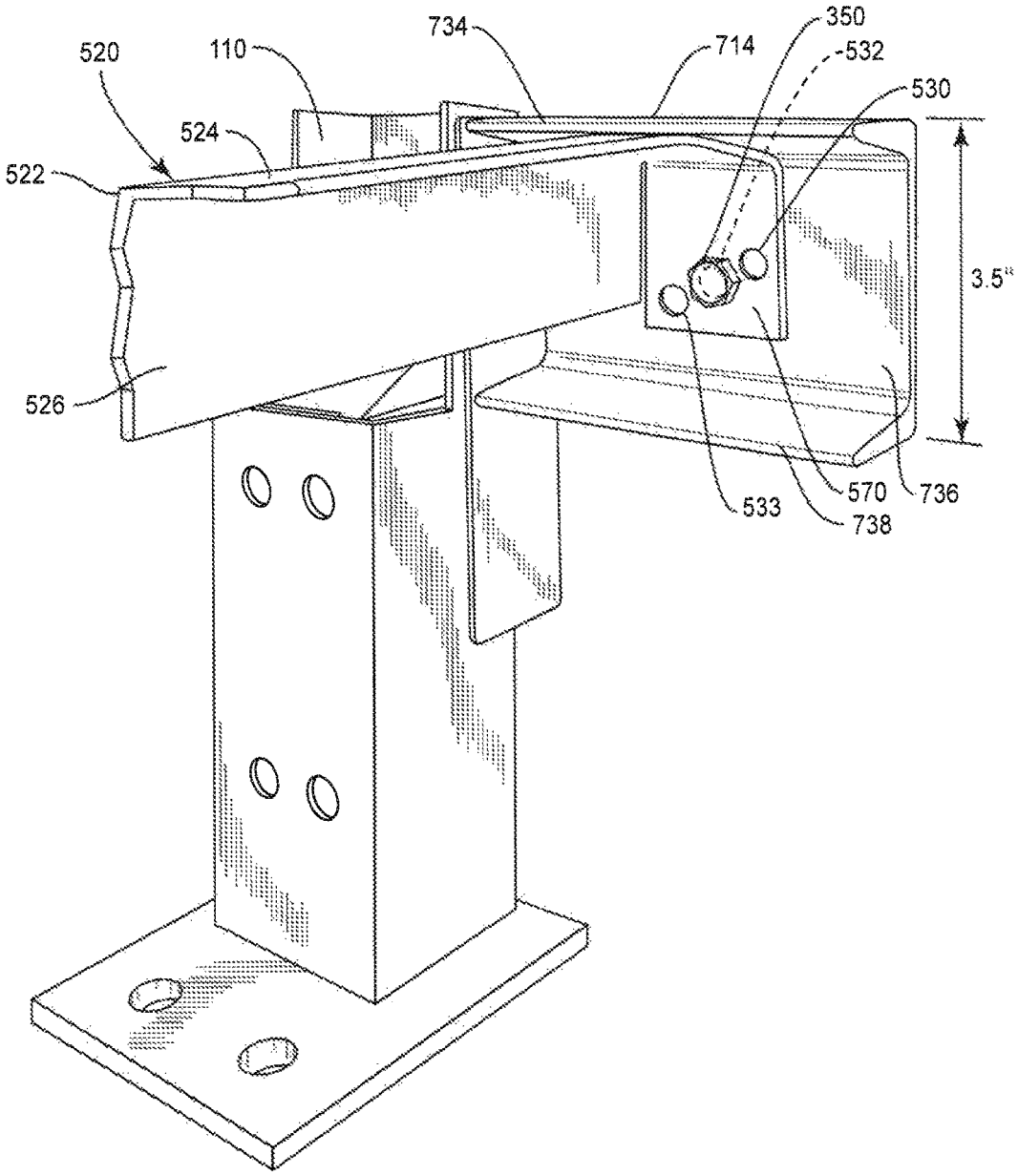

Referring to FIGS. 7A-B, second hole 532 of structural member 520 is aligned with center hole 740 of three and a half inch horizontal bar 714. Similar to other horizontal bars discussed herein, three and a half inch horizontal bar 714 includes an upper plane 734, middle plane 736 and lower plane 738. When structural member 520 is connected with horizontal bar 714, first piece 524 of structural member 520 is adjacent to upper plane 734 and connection component 570 is fastened to and adjacent to middle plane 736.

Figure 8A:
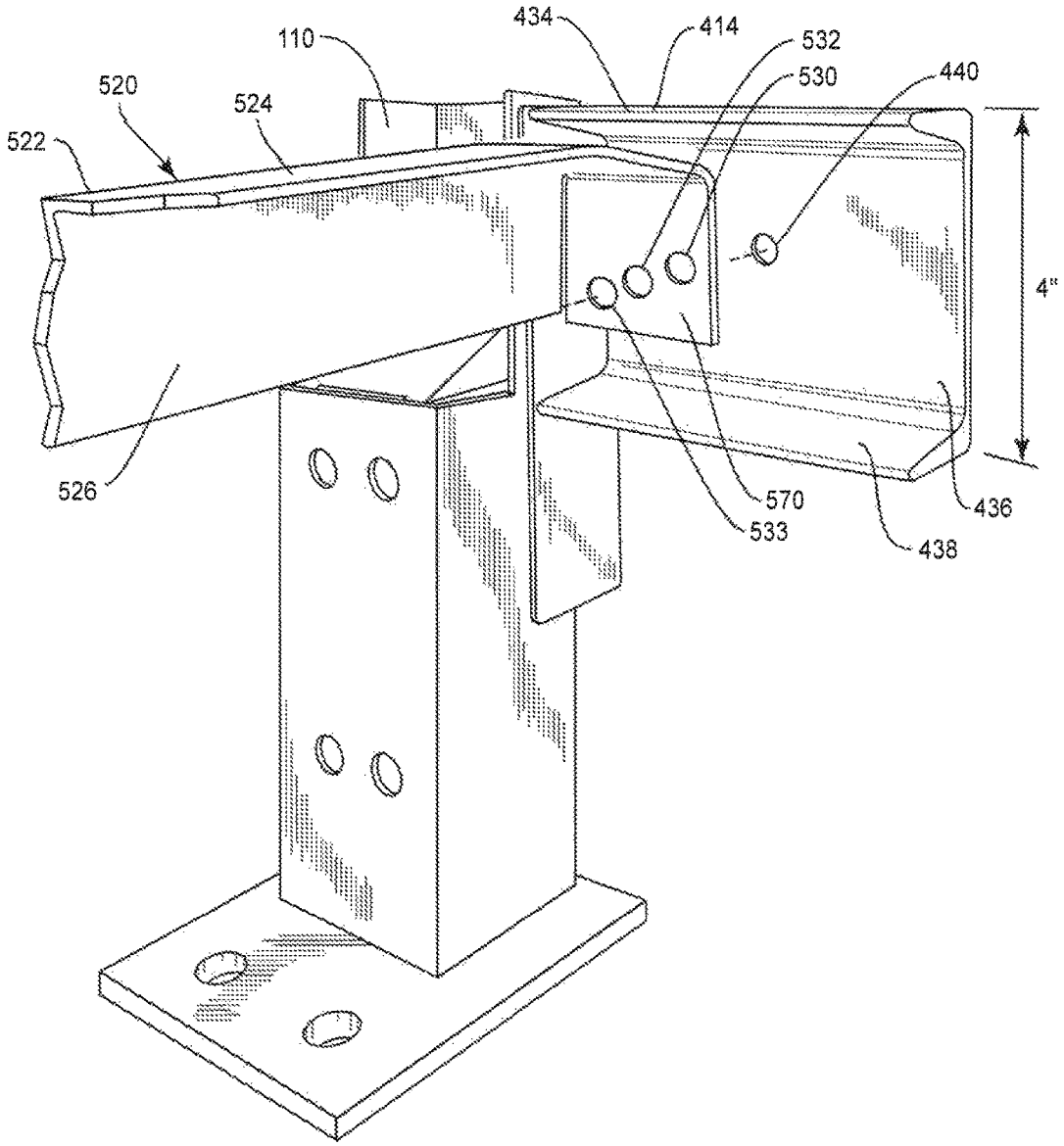
FIGS. 8A-B illustrate the three-hole structural member connecting with a horizontal bar having a third size in accordance with aspects of the present disclosure.
Figure 8B:
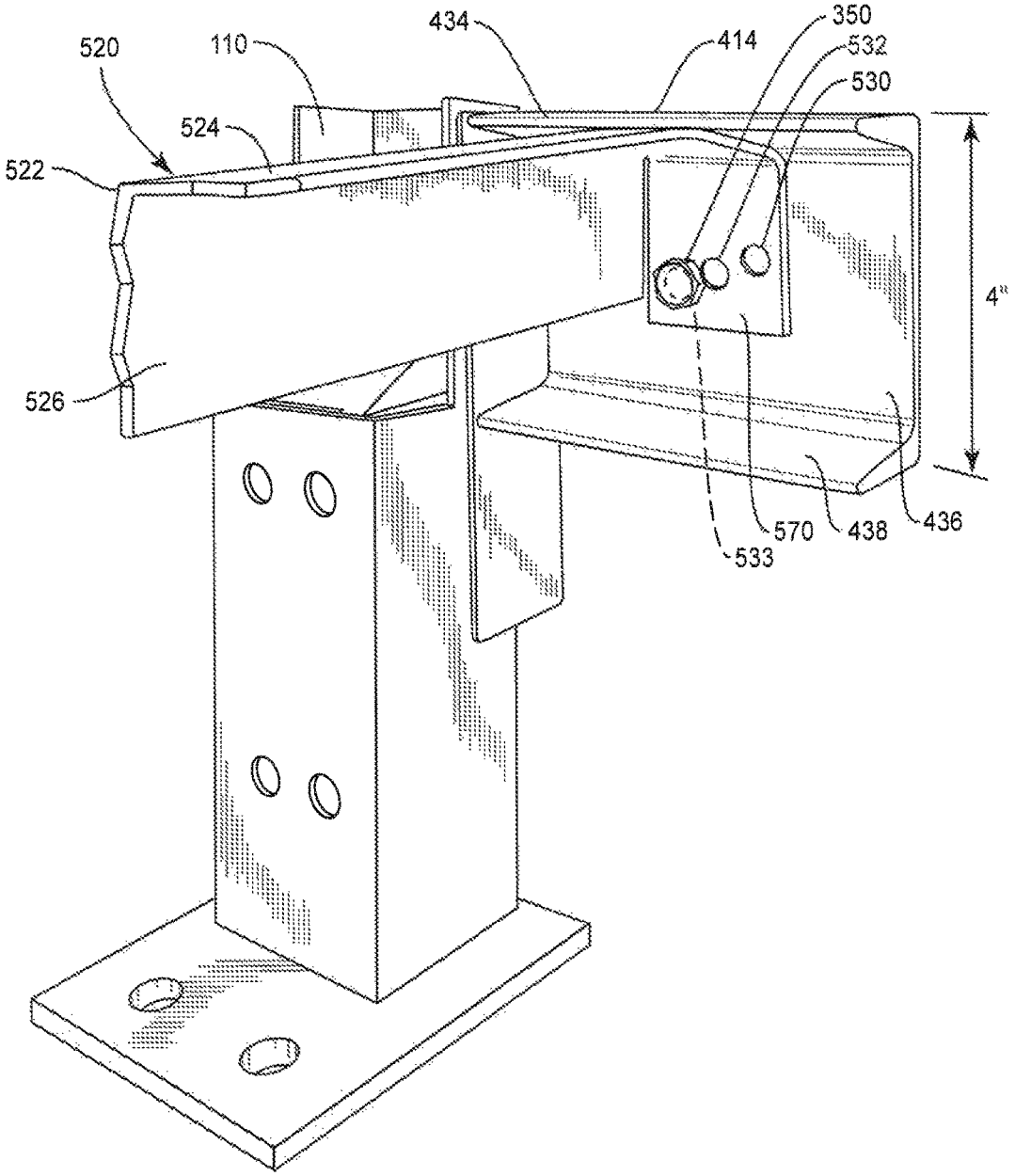

Referring to FIGS. 8A-B, third hole 533 of structural member 520 is aligned with center hole 440 of four inch horizontal bar 414. When structural member 520 is connected with horizontal bar 414, first piece 524 of structural member 520 is adjacent to upper plane 434 and connection component 570 is fastened to and adjacent to middle plane 436.

Structural member 520 serves similar advantages as structural member 120, only structural member 520 is adaptable for three different width sizes of horizontal bars or platforms. For instance, in addition to structural member 520 being a universal structural member by having the three holes on connection component 570, structural member also serves as an anti-rotation device so that structural member 120 is always level. Specifically, first piece 524 of structural member 520 may collide with any of the upper planes across the horizontal members when structural member 520 begins to rotate. As a result, structural member 520 is always in at least a substantially level position.

The present disclosure is advantageous because the structural member is universal in that a single structural member may be manufactured and adaptable for multiple sizes of storage racks. In particular, storage racks that have horizontal members that are three inches, four inches, or three and a half inches may be utilized. Thus, the ability to use the same structural member for each sized storage rack provides for easier manufacturing and predictability in terms of making the structural member. Furthermore, the positioning of the structural member with respect to the horizontal bar that it is adjacent to prohibits the structural member from rotating in either direction. For example, the upper component, or first piece as discussed above, of the structural member acts as an anti-rotation component in that it collides with the upper plane of the horizontal bar, thereby prohibiting the structural member from rotating. This increases the functionality of the storage rack overall in that the structural member will maintain its posture as a component within the storage rack, rather than rotating and causing slippage or other uneven storing of materials on the storage rack.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

The invention claimed is:

1. A structural member, comprising:

a central portion defining a longitudinal axis and including a first end portion and a second end portion, the central portion having a substantially uniform cross-sectional L-shape configuration along the longitudinal axis;

at least one first connection component extending from the first end portion; and the L-shape comprises a first piece and a second piece and the first connection component extends at the first end portion from the first piece, the first piece includes a first plane at the central portion that runs substantially perpendicular to the connection component, and the first piece further includes a slope at the first end portion that forms an acute angle to the first plane to form a gap between the connection component and the first plane.

2. The structural member of claim 1, wherein the first connection component includes at least two holes.

3. A structural member and a horizontal beam, comprising:

a central portion defining a longitudinal axis and including a first end and a second end, the central portion having a substantially uniform cross-sectional L-shape configuration along the longitudinal axis;

at least one first connection component extending from the first end and including at least one hole;

the horizontal beam having a hole therethrough, the horizontal beam having a longitudinal axis and a length perpendicular to the longitudinal axis is three inches, three and one-half inches, or four inches, and wherein when the length perpendicular to the longitudinal axis is three inches, a first hole of the at least one hole of the first connection component of the first end aligns with the hole of the horizontal beam;

when the length perpendicular to the longitudinal axis is four inches, the first connection component comprises a second hole and the second hole aligns with the hole of the horizontal beam; and when the length perpendicular to the longitudinal axis is three and one-half inches, the first connection component comprises a third hole and the third hole aligns with the hole of the horizontal beam.

4. The structural member of claim 1, wherein the slope includes a first slope plane and a second slope plane, the first slope plane extends at a first angle and the second slope plane extends at a second angle, the second angle being different than the first angle.

5. The structural member of claim 1, comprising a second connection component extending from the second end, the second connection component having at least two holes.

6. The structural member and horizontal beam of claim 3, wherein the horizontal beam forms a cross sectional C-shape that has an upper plane, a lower plane, and a middle plane positioned in between the upper plane and the lower plane, the hole defined by the horizontal beam is positioned on the middle plane, and when the structural member is connected to the horizontal beam, the first connection component of the structural member is adjacent to and extends parallel to the middle plane of the horizontal beam.

7. The structural member and horizontal beam of claim 6, wherein the hole through the horizontal beam is positioned in a center of the horizontal beam relative to a length perpendicular to the longitudinal axis of the horizontal beam.

8. The structural member of claim 1, wherein the first connection component comprises a first, a second and a third hole and each of the first, second, and third holes on the first connection component are off-centered.

9. The structural member and horizontal beam of claim 3, wherein the cross-sectional L-shape configuration along the longitudinal axis of the central portion is formed by a first piece and a second piece and the first connection component extends from the first piece and the first piece includes a first plane that runs substantially perpendicular to the first connection component, and the first piece further includes a slope that extends at a different angle than the first plane.

10. The structural member and horizontal beam of claim 9, wherein the first piece is configured and adapted such that when pressure is exerted on the horizontal beam, such that the horizontal beam begins to rotate about an axis, a portion of the first piece will contact the upper plane of the horizontal beam, thereby preventing the horizontal beam from rotating, the upper plane of the horizontal beam is positioned above the middle plane and runs perpendicular to the middle plane.

11. The structural member and horizontal beam of claim 10, wherein a top surface of the first piece of the structural member contacts a bottom surface of the upper plane of the horizontal beam.

12. A structural member, comprising:

a central portion defining a longitudinal axis and including a first end portion and a second end portion, the central portion having a substantially uniform cross-sectional L-shape configuration along the longitudinal axis;

a first connection component extending from the first end portion, the first connection component comprising at least two holes therethrough, the two holes being off-centered on the connection component; and the L-shape comprises a first piece and a second piece and the connection component extends from the first piece, the first piece includes a first plane at the central portion that runs substantially perpendicular to the connection component, and the first piece further includes a slope that extends at an acute angle to the first plane.

13. The structural member of claim 12, further comprising a third hole through the first connection component, wherein the third hole is also off-centered.

14. The structural member of claim 12, wherein the first connection component is not connected to and does not contact the second piece.

15. The structural member of claim 14, further comprising a horizontal beam having a hole through a surface thereof, and the structural member is configured and adapted such that when the first connection component is in contact with a portion of the horizontal beam, one of the holes of the first connection component is aligned with the hole of the horizontal beam.

16. The structural member of claim 15, wherein the horizontal beam forms a cross sectional C-shape that has an upper plane, a lower plane, and a middle plane, and when the structural member is connected to the horizontal beam, the first connection component of the structural member is adjacent and runs parallel to the middle plane of the horizontal beam.

17. The structural member of claim 16, wherein a top surface of the first piece of the structural member contacts a bottom surface of the upper plane of the horizontal beam.

18. The structural member of claim 17, wherein the structural member is configured and adapted such that when pressure is exerted on the structural member such that the structural member begins to rotate about an axis, at least a portion of the first piece contacts the upper plane of the horizontal beam, thereby preventing the structural member from rotating.

19. The structural member of claim 15, wherein the hole of the horizontal beam is positioned in a center of the middle plane of the horizontal beam, the center being relative to the length perpendicular to a longitudinal axis of the horizontal beam.

20. The structural member of claim 12, wherein the slope includes a first slope plane and a second slope plane, the first slope plane extends at a first angle and the second slope plane extends at a second angle, the second angle being different than the first angle.

* * * * *